US010519894B2

(12) United States Patent
Hirata

(10) Patent No.: US 10,519,894 B2
(45) Date of Patent: Dec. 31, 2019

(54) CONTROL DEVICE FOR INTERNAL COMBUSTION ENGINE

(71) Applicant: DENSO CORPORATION, Kariya, Aichi-pref. (JP)

(72) Inventor: Yasuo Hirata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/086,114

(22) PCT Filed: Mar. 22, 2017

(86) PCT No.: PCT/JP2017/011433
§ 371 (c)(1),
(2) Date: Sep. 18, 2018

(87) PCT Pub. No.: WO2017/170031
PCT Pub. Date: Oct. 5, 2017

(65) Prior Publication Data

US 2019/0195164 A1 Jun. 27, 2019

(30) Foreign Application Priority Data

Mar. 28, 2016 (JP) ..... 2016-063161

(51) Int. Cl.
*F02M 63/02* (2006.01)
*F02D 45/00* (2006.01)
*F02M 55/02* (2006.01)

(52) U.S. Cl.
CPC ..... *F02D 45/00* (2013.01); *F02M 55/02* (2013.01); *F02M 63/0235* (2013.01);
(Continued)

(58) Field of Classification Search
CPC ..... F02D 31/003; F02D 41/08; F02D 2200/0602; F02D 2700/0289;
(Continued)

(56) References Cited

U.S. PATENT DOCUMENTS

2007/0283929 A1* 12/2007 Funabashi ..... F02D 33/006 123/446
2008/0203347 A1* 8/2008 Burrola ..... F02M 55/04 251/284

(Continued)

FOREIGN PATENT DOCUMENTS

JP 5525760 6/2014

*Primary Examiner* — Erick R Solis
(74) *Attorney, Agent, or Firm* — Nixon & Vanderhye P.C.

(57) ABSTRACT

A control device is applied for an internal combustion engine which is provided with a high-pressure fuel pump driven by a driving shaft of the internal combustion engine to discharge a fuel pressurized in a pressurizing chamber, an accumulator accumulating a high-pressure fuel discharged from the high-pressure fuel pump, and a relief valve which is opened when a fuel pressure in the accumulator is higher than a specified pressure in order to return the fuel in the accumulator to a specified chamber where a fuel has lower pressure than a fuel in the pressurizing chamber. An idle speed of the internal combustion engine is increased to a specified speed when the fuel pressure in the accumulator has been higher than a determination pressure, which is lower than the specified pressure, for a first period or longer.

5 Claims, 4 Drawing Sheets

(52) U.S. Cl.
CPC ..... *F02M 63/0245* (2013.01); *F02M 63/0225* (2013.01); *F02M 2200/80* (2013.01)

(58) Field of Classification Search
CPC ..... F02D 2700/0297; F02M 55/02; F02M 63/023; F02M 63/0235; F02M 63/0245
USPC ..... 123/339.14, 459, 508
See application file for complete search history.

(56) References Cited

U.S. PATENT DOCUMENTS

2010/0139624 A1* 6/2010 Surnilla ..... F02D 41/2464 123/511
2015/0337753 A1* 11/2015 Stickler ..... F02M 57/02 123/506

* cited by examiner

CONTROL DEVICE FOR INTERNAL COMBUSTION ENGINE

CROSS REFERENCE TO RELATED APPLICATION

This application is the U.S. national phase of International Application No. PCT/JP2017/011433 filed Mar. 22, 2017 which designated the U.S. and claims priority to Japanese Patent Application No. 2016-063161 filed on Mar. 28, 2016, the entire contents of each of which are incorporated herein by reference.

TECHNICAL FIELD

The present disclosure relates to a control device for an internal combustion engine provided with a high-pressure fuel pump.

BACKGROUND ART

Conventionally, when a high-pressure fuel pump has a malfunction, a relief valve is opened so that a maximum pressure in an accumulator does not exceed a valve-opening limit pressure of a fuel injector.

PRIOR ART LITERATURE

Patent Literature

Patent Literature 1: Japanese Patent No. 5525760

SUMMARY OF INVENTION

In a device shown in Patent Literature 1, when the relief valve is opened, the fuel pressure in the accumulator is lower than the valve-opening limit pressure of the fuel injector, but is higher than a normal range. If the accumulator is continuously used at a pressure higher than the normal range, it is likely that the withstand pressure of the accumulator may be lowered. Meanwhile, it is conceivable that the fuel pressure in the accumulator is decreased to causes no deterioration in withstand pressure when the relief valve is opened.

However, if the high-pressure fuel pump is deteriorated or a low-viscosity fuel is used, the fuel pressure in the accumulator becomes higher than the normal range and becomes lower than the valve opening pressure of the relief valve when the high-pressure fuel pump has a malfunction. In this case, the relief valve is not opened and the accumulator is continuously used in a pressure which is higher than the normal range.

It is an object of the present disclosure to provide a control device for an internal combustion engine, which easily decrease a fuel pressure in an accumulator when a high-pressure fuel pump has a malfunction even if a high-pressure fuel pump is deteriorated or a low-viscosity fuel is used.

In order to achieve the above object, the present disclosure has following construction.

According to an aspect of the present disclosure, a control device is applied to an internal combustion engine which is provided with a high-pressure fuel pump driven by a driving shaft of the internal combustion engine to discharge a fuel pressurized in a pressurizing chamber, an accumulator accumulating a high-pressure fuel discharged from the high-pressure fuel pump, and a relief valve which is opened when a fuel pressure in the accumulator is higher than a specified pressure in order to return the fuel in the accumulator to a specified chamber where a fuel has lower pressure than a fuel in the pressurizing chamber. An idle speed of the internal combustion engine is increased to a specified speed when the fuel pressure in the accumulator has been higher than a determination pressure, which is lower than the specified pressure, for a first period or longer.

The high-pressure fuel pump is driven by the driving shaft of the internal combustion chamber, and discharges a fuel which has been pressurized in the pressurizing chamber. The fuel discharged from the high-pressure fuel pump is stored in the accumulator in a pressurized state. When the fuel pressure in the accumulator is higher than a specified pressure, the relief valve is opened so that the fuel in the accumulator is returned into a specified chamber where a fuel has lower pressure than a fuel in the pressurizing chamber. By opening the relief valve, the fuel pressure in the accumulator can be lowered than the fuel pressure in the pressurizing chamber. It can be restricted that a withstand pressure of the accumulator is deteriorated.

An idle speed of the internal combustion engine is increased to a specified speed when the fuel pressure in the accumulator has been higher than a determination pressure, which is lower than the specified pressure, for a first period or longer. The high-pressure fuel pump is driven by the driving shaft of the internal combustion engine. By increasing the idle speed of the internal combustion engine, the discharge amount of the high-pressure fuel pump can be increased. Thus, even if the high-pressure fuel pump is deteriorated or the low viscosity fuel is used, the fuel pressure in the accumulator can be easily increased to the valve opening pressure of the relief valve. As a result, when the high-pressure fuel pump has a malfunction, the fuel pressure in the accumulator can be easily decreased, so that the design withstand pressure of the accumulator can be lowered.

BRIEF DESCRIPTION OF DRAWINGS

The above and other objects, features and advantages of the present disclosure will become more apparent from the following detailed description referring to the drawings described herein.

DESCRIPTION OF EMBODIMENTS

Referring to drawings, an embodiment which is applied to a four-cylinder gasoline engine (internal combustion engine) will be described.

Figure 1:
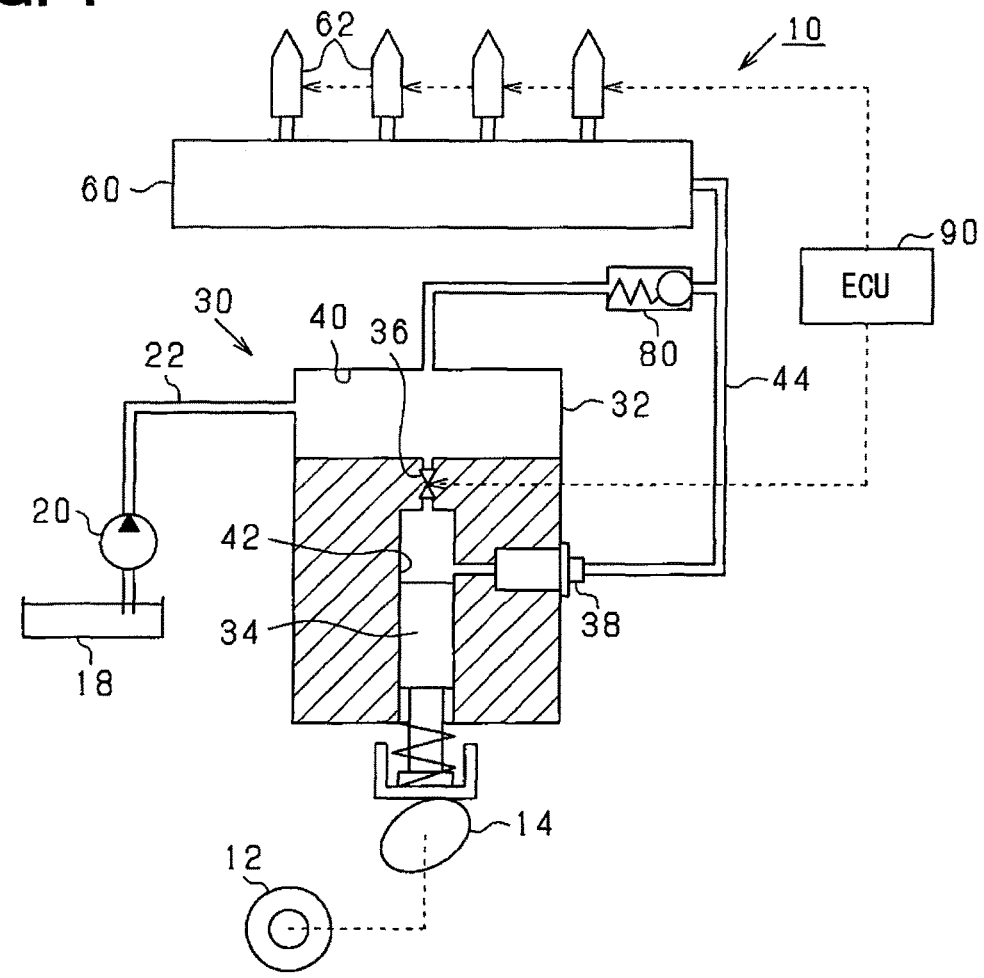
FIG. 1 is a schematic diagram showing an engine and its peripheral configuration.

As shown in FIG. 1, an engine 10 is provided with a crankshaft 12 (a drive shaft), a cam 14, a low-pressure fuel pump 20, a high-pressure fuel pump 30, a delivery pipe 60, a fuel injector 62, a relief valve 80, etc. The cam 14 is driven by the crankshaft 12.

The low-pressure fuel pump 20 suctions fuel in a fuel tank 18, pressurizes the fuel, and discharges the pressurized fuel. The pressure of fuel discharged by the low-pressure fuel pump 20 is regulated by a regulator (not shown).

The high-pressure fuel pump 30 includes a cylinder body 32, a plunger 34, a metering valve 36, a discharge valve 38, and the like.

The cylinder body 32 defines a low pressure chamber 40 and a pressurizing chamber 42. The fuel discharged by the low-pressure fuel pump 20 is supplied to the low-pressure chamber 40 (corresponding to a specified chamber) through a pipe 22. That is, the fuel discharged by the low-pressure fuel pump 20 is stored in the low pressure chamber 40. The low pressure chamber 40 and the pressurizing chamber 42 are fluidly connected with each other through the metering valve 36. The metering valve 36 switches a communication between the low pressure chamber 40 and the pressurizing chamber 42. The metering valve 36 is controlled by an ECU (Electric Control Unit) 90.

A plunger 34 is supported by the cylinder body 32 in such a manner as to reciprocate therein. The plunger 34 is driven by the rotation of the cam 14. The plunger 34 reciprocates to suction the fuel from the low pressure chamber 40 into the pressurizing chamber 42, and to pressurize the fuel in the pressurizing chamber 42. The fuel pressurized in the pressurizing chamber 42 is supplied to the delivery pipe 60 through the discharge valve 38 and the pipe 44. The discharge valve 38 is a check valve that allows fuel to flow only from the pressurizing chamber 42 to the pipe 44, and opens when the pressure of the fuel in the pressurizing chamber 42 becomes equal to or higher than a predetermined discharge pressure.

The delivery pipe 60 (corresponding to an accumulator) stores the high pressure fuel discharged from the high-pressure fuel pump 30. The relief valve 80 is opened when the fuel pressure in the delivery pipe 60 (pipe 44) is higher than the valve opening pressure (corresponding to a predetermined pressure), so that the fuel in the delivery pipe 60 is returned to the low pressure chamber 40. This valve opening pressure is set lower than a withstand pressure (rail pressure resistance) before the delivery pipe 60 is deteriorated (fatigued). The fuel pressure in the low pressure chamber 40 is lower than the fuel pressure in the pressurizing chamber 42. When the relief valve 80 is opened, the fuel pressure in the delivery pipe 60 is maintained at the fuel pressure in the low pressure chamber 40.

Four fuel injectors 62 are provided to the delivery pipe 60. The fuel injector 62 directly injects the fuel in the delivery pipe 60 into the cylinder of the engine 10. The fuel injector 62 is controlled by the ECU 90.

The ECU 90 (corresponding to a control device) is a microcomputer including a CPU, a ROM, a RAM, a drive circuit, an input/output interface, and the like. The ECU 90 is an engine ECU for controlling the engine 10 and executes an idle speed control in which an idle speed is kept at a target idle speed.

An operation of the high-pressure fuel pump 30 will be described.

(1) Suction Stroke

When the plunger 34 slides down to decrease the fuel pressure in the pressurizing chamber 42, the fuel is introduced from the low pressure chamber to the pressurizing chamber 42. Then, the ECU 90 controls the metering valve 36 so as to maintain the valve open state.

(2) Return Stroke

In a condition where the metering valve 36 is opened, even when the plunger 34 slides up from a bottom dead center to a top dead center, the fuel in the pressurizing chamber 42 is returned to the low pressure chamber through the metering valve 36.

(3) Pressurizing Stroke

During the return stroke, the ECU 90 closes the metering valve 36. When the plunger 34 slides up to the top dead center, the fuel in the pressurizing chamber 42 is pressurized. Then, when the fuel pressure in the pressurizing chamber 42 exceeds a predetermined pressure, a discharge valve 38 is opened. The fuel discharged from the discharge valve 38 is stored in the delivery pipe 60 and supplied to the fuel injector 62.

The high-pressure fuel pump 30 discharges the pressurized fuel by repeating the above strokes (1)-(3). The discharge amount of fuel is adjusted by controlling a valve close timing of the metering valve 36.

Figure 2:
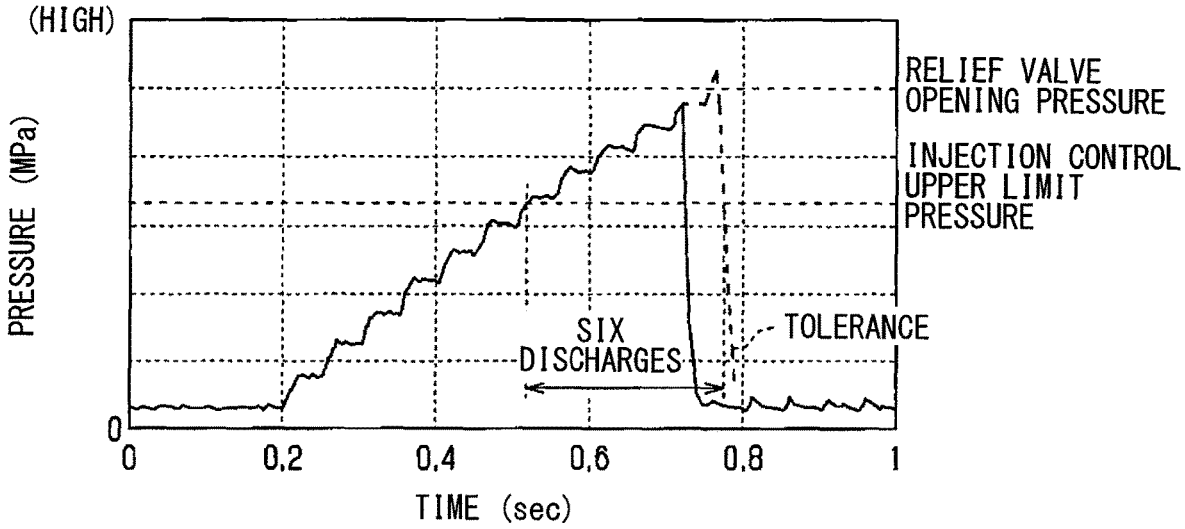
FIG. 2 is a chart showing a relationship between a discharge of a high-pressure fuel pump and a discharge pressure variation of a high-pressure fuel pump in a condition where no fuel injection is performed.

FIG. 2 is a chart showing a relationship between a discharge of the high-pressure fuel pump 30 and a discharge pressure variation of the high-pressure fuel pump 30 in a condition where no fuel injection is performed. In FIG. 2, the engine 10 is running at 600 rpm, which corresponds to an idling state, and the high-pressure fuel pump 30 discharges the fuel while the fuel injector 62 injects no fuel. As shown in FIG. 2, the fuel pressure in the delivery pipe 60 rises with every discharge by the high-pressure pump 30. Around a time of 0.5 s, the fuel pressure reaches an upper limit pressure at which an injection by the fuel injector 62 can be controlled. Then, after the high-pressure pump 30 discharge the fuel six times, the fuel pressure reaches the valve opening pressure of the relief valve 80, so that the relief valve 80 is opened. When the relief valve 80 is opened, the fuel pressure in the delivery pipe 60 is maintained at the fuel pressure in the low pressure chamber 40. The pressure indicated by a broken line shows a case where a clearance of the plunger 34 is a minimum within a tolerance.

Figure 3:
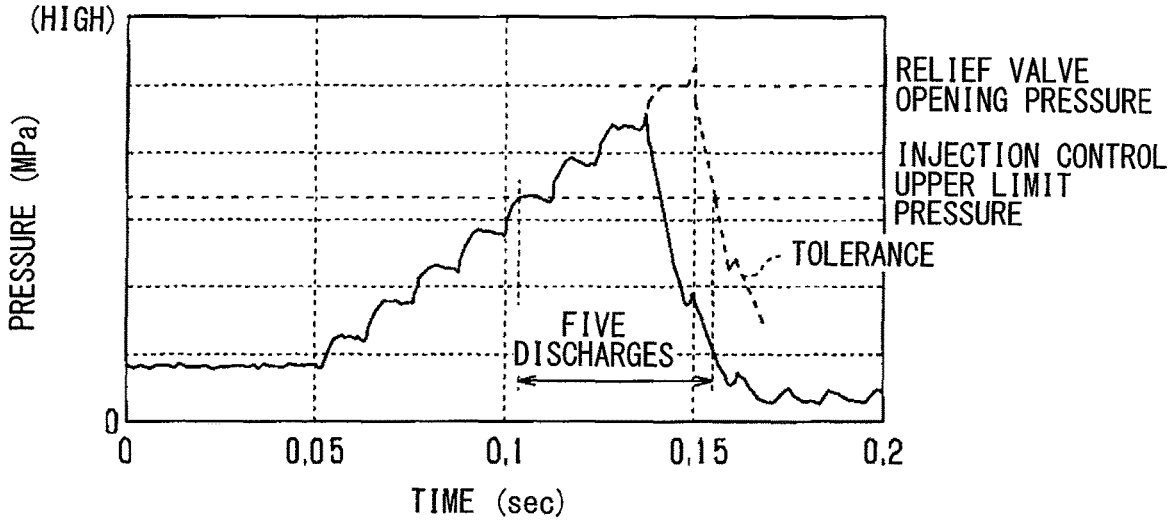
FIG. 3 is another chart showing a relationship between a discharge of a high-pressure fuel pump and a discharge pressure variation of a high-pressure fuel pump in a condition where no fuel injection is performed.

FIG. 3 shows the same relationship as FIG. 2 in a case where the engine is running at 2500 rpm that is upper limit for fail-safe. As shown in FIG. 3, the fuel pressure in the delivery pipe 60 rises with every discharge by the high-pressure pump 30. Around a time of 0.1 s, the fuel pressure reaches an upper limit pressure at which an injection by the fuel injector 62 can be controlled. Then, after the high-pressure pump 30 discharge the fuel five times, the fuel pressure reaches the valve opening pressure of the relief valve 80, so that the relief valve 80 is opened. When the relief valve 80 is opened, the fuel pressure in the delivery pipe 60 is maintained at the fuel pressure in the low pressure chamber 40.

Figure 4:
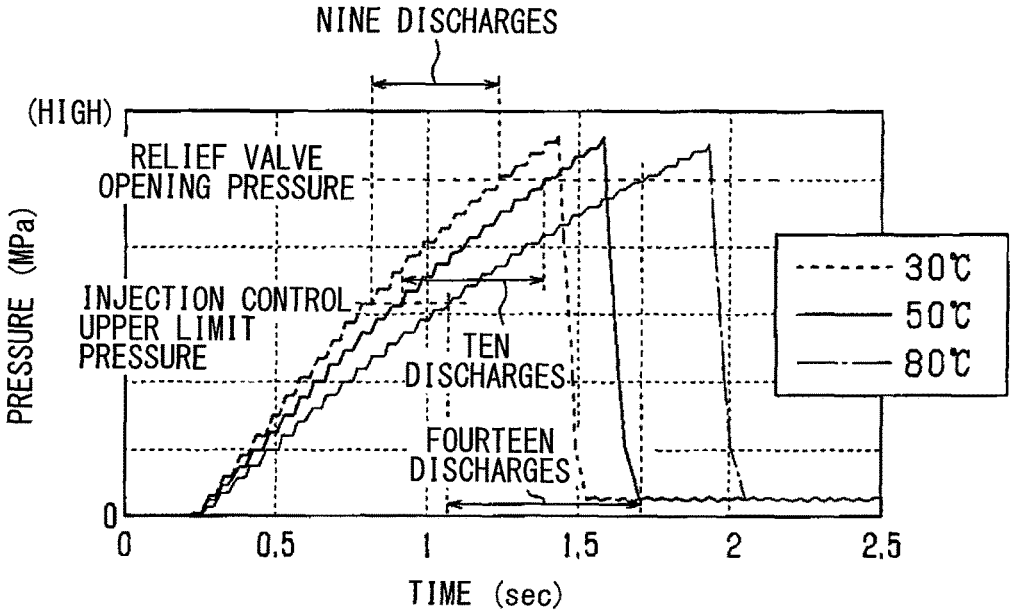
FIG. 4 is another chart showing a relationship between a discharge of a high-pressure fuel pump and a discharge pressure variation of a high-pressure fuel pump in a condition where no fuel injection is performed.

FIG. 4 shows the same relationship as FIG. 2, in a case where the engine is running at 600 rpm, a lift amount of the plunger 34 is small, a clearance of the plunger 34 is a maximum within a tolerance, and the fuel temperature is 30° C., 50° C., 80° C. As shown in FIG. 4, an increase amount of the fuel pressure in the delivery pipe 60 is decreasing with every discharge by the high-pressure pump 30. As the fuel temperature is higher, the number of discharge is increased after the fuel pressure reaches the injection control upper limit until the fuel pressure reaches the relief valve opening pressure.

Figure 5:
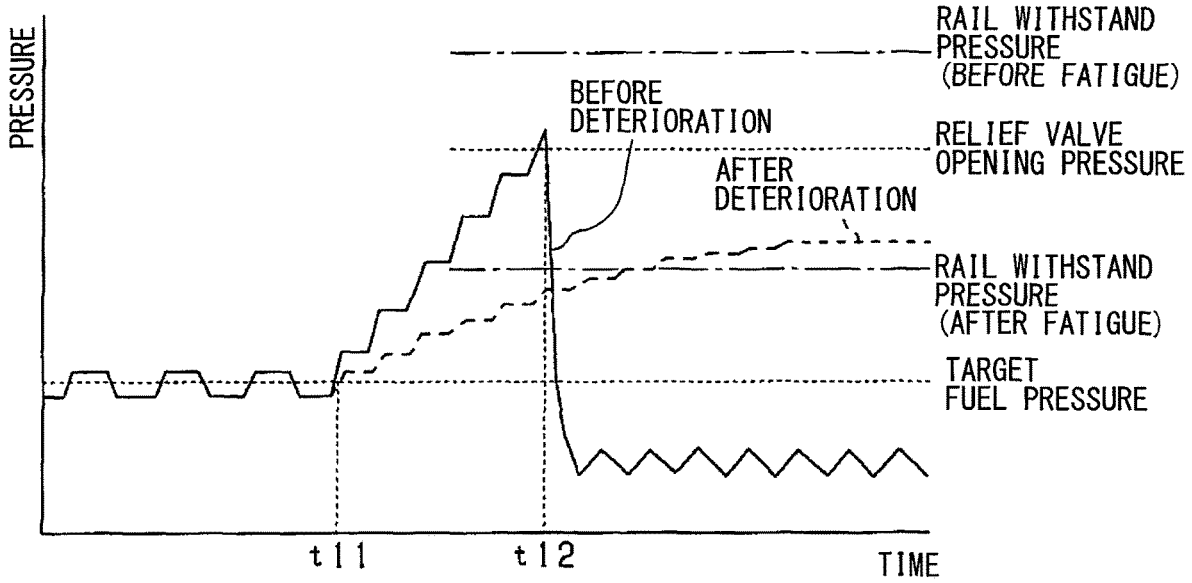
FIG. 5 is a chart showing a pressure variation at idling state when a high-pressure fuel pump has a malfunction.

FIG. 5 is a chart showing a pressure variation in case where the engine 10 is at idling state and the high-pressure fuel pump 30 has a malfunction. At a time of t11, a malfunction occurs in a drive system or a control system of the high-pressure pump 30. Then, the discharge amount of the high-pressure pump 30 does not vary from a maximum amount (the total amount in the pressurizing stroke).

Before the high-pressure fuel pump 30 is deteriorate as shown by a solid line, the fuel pressure in the delivery pipe 60 is sharply increased and the relief valve 80 is opened at a time of t12. After the high-pressure fuel pump 30 is deteriorated as shown by a broken line, a clearance of the plunger 34 is large and the fuel pressure in the delivery pipe 60 is gradually increased. The fuel pressure in the delivery pipe 60 does not reach a valve opening pressure of the relief valve 80. Then, when the delivery pipe 60 is continuously used under a pressure which is higher than a normal range, the delivery pipe 60 may be deteriorated (fatigued) and the withstand pressure of the delivery pipe 60 falls below the fuel pressure in the delivery pipe 60. Further, it is likely that the fuel pressure in the delivery pipe 60 may exceed an upper limit pressure at which the fuel injector 62 can be controlled. If the fuel pressure in the delivery pipe 60 exceeds the upper limit pressure at which an injection by the fuel injector 62 can be controlled, it is likely that the fuel may leak from the delivery pipe 60, the pipe 44, and the fuel injector 62.

Figure 6:
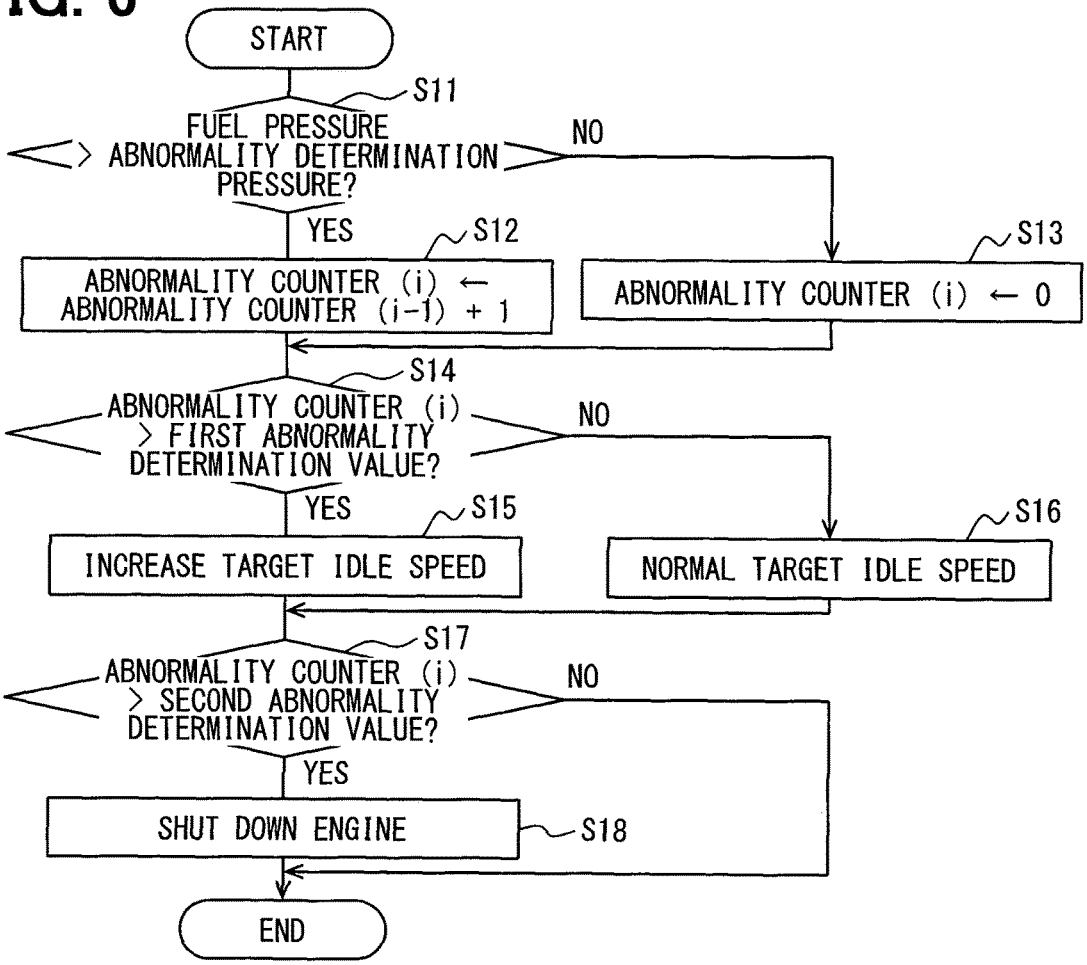
FIG. 6 is a flow chart showing a procedure of an engine control for expediting an opening of a relief valve.

According to the present embodiment, when a malfunction occurs in the high-pressure fuel pump 30, an engine control for opening the relief valve 80 is performed. FIG. 6 is a flow chart showing the procedure of the engine control. The procedure is repeatedly performed by the ECU 90.

First, it is determined whether the fuel pressure in the delivery pipe 60 is higher than the abnormality determination pressure (S11). The abnormality determination pressure (determination pressure) is lower than the withstand pressure after deterioration of the delivery pipe 60. The abnormality determination pressure is lower than the upper limit pressure at which an injection by the fuel injector 62 can be controlled. The abnormality determination pressure is lower than a valve opening pressure of the relief valve 80. When it is determined that the fuel pressure in the delivery pipe 60 is higher than the abnormality determination pressure (S11: YES), a value of an abnormality counter (i) is incremented (S12). Specifically, a previous value the abnormality counter (i−1) is incremented by "1" to obtain a current value of the abnormality counter (i). Meanwhile, when it is determined that the fuel pressure in the delivery pipe 60 is not higher than the abnormality determination pressure (S11: NO), the value of the abnormality counter (i) is reset to "0".

Then, it is determined whether the value of the abnormality counter (i) is larger than a first abnormality determination value (S14). The first abnormality determination value is a value at which it can be determined that the fuel pressure in the delivery pipe 60 does not reach the valve opening pressure of the delivery pipe 60. A period from when the fuel pressure in the delivery pipe 60 exceeds the abnormality determination pressure until when the value of the abnormality counter (i) is the first abnormality determination value. When it is determined that the value of the abnormality counter (i) is larger than the first abnormality determination value (S14: YES), the target idle speed of the engine 10 is increased to a specified speed (S15). For example, the specified speed is set to 1000 rpm. Meanwhile, when it is determined that the value of the abnormality counter (i) is not larger than the first abnormality determination value (S14: NO), the target idle speed of the engine 10 is set to a normal target idle speed (for example, 600 rpm) (S16).

Then, it is determined whether the value of the abnormality counter (i) is larger than a second abnormality determination value which is larger than the first abnormality determination value (S17). The second abnormality determination value is set to a value at which it can be restricted that the withstand pressure of the delivery pipe 60 is decreased due to a deterioration of the delivery pipe 60. A period from when the value of the abnormality counter (i) becomes the first abnormality determination value until when the value of the abnormality counter (i) becomes the second abnormality determination value corresponds to a second period. When it is determined that the value of the abnormality counter (i) is larger than the first abnormality determination value (S17: YES), the engine 10 is stopped (S18). Specifically, the fuel injection by the fuel injector 62 is terminated and an ignition by the spark plug is stopped. Then, the procedure is terminated (END). Meanwhile, when it is determined that the value of the abnormality counter (i) is not larger than the second abnormality determination value (S17: NO), the procedure is terminated (END).

Figure 7:
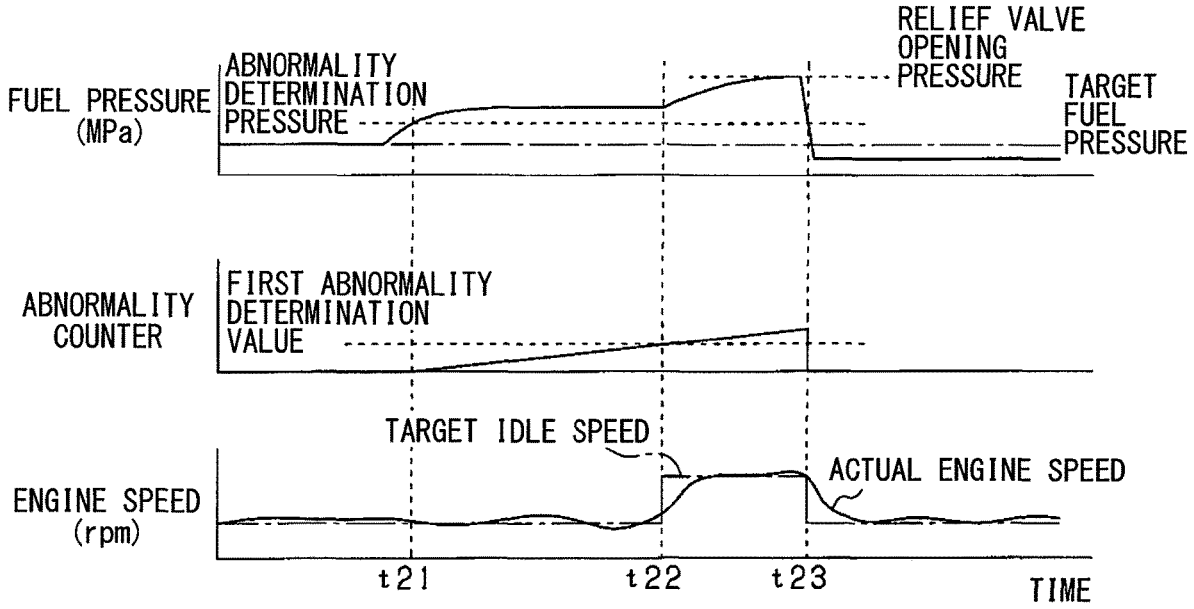
FIG. 7 is a time chart showing an operation of the engine control shown in FIG. 6.

FIG. 7 is a time chart showing an operation of the engine control shown in FIG. 6.

At a time of t21, the fuel pressure in the delivery pipe 60 becomes higher than the abnormality determination pressure, and the abnormality counter (i) starts counting. After the time of t21, the fuel pressure in the delivery pipe 60 increases, but does not reach the valve opening pressure of the relief valve 80. At a time of t22, the value of the abnormality counter (i) becomes larger than the first abnormality determination value and the target idle speed of the engine 10 is increased to 1000 rpm. After the time of t22, the discharge amount of the high-pressure fuel pump 30 is increased and the fuel pressure in the delivery pipe 60 is increased. At a time of t23, the fuel pressure in the delivery pipe 60 is increased to a valve opening pressure of the relief valve 80, so that the relief valve 80 is opened. Thereby, the fuel pressure in the delivery pipe 60 is decreased to the fuel pressure in the low pressure chamber 40 and the target idle speed of the engine 10 is set to 600 rpm. After the time of t23, the actual idle speed of the engine 10 is maintained around 600 rpm.

However, it is likely that the high-pressure pump 30 is excessively deteriorated or the low viscosity fuel is used unexpectedly. In this case, even if the idle speed of the engine 10 is increased to a specified speed, the fuel pressure in the delivery pipe 60 may not increase to a valve opening pressure of the relief valve 80. As a result, the withstand pressure of the delivery pipe 60 may be decreased.

Figure 8:
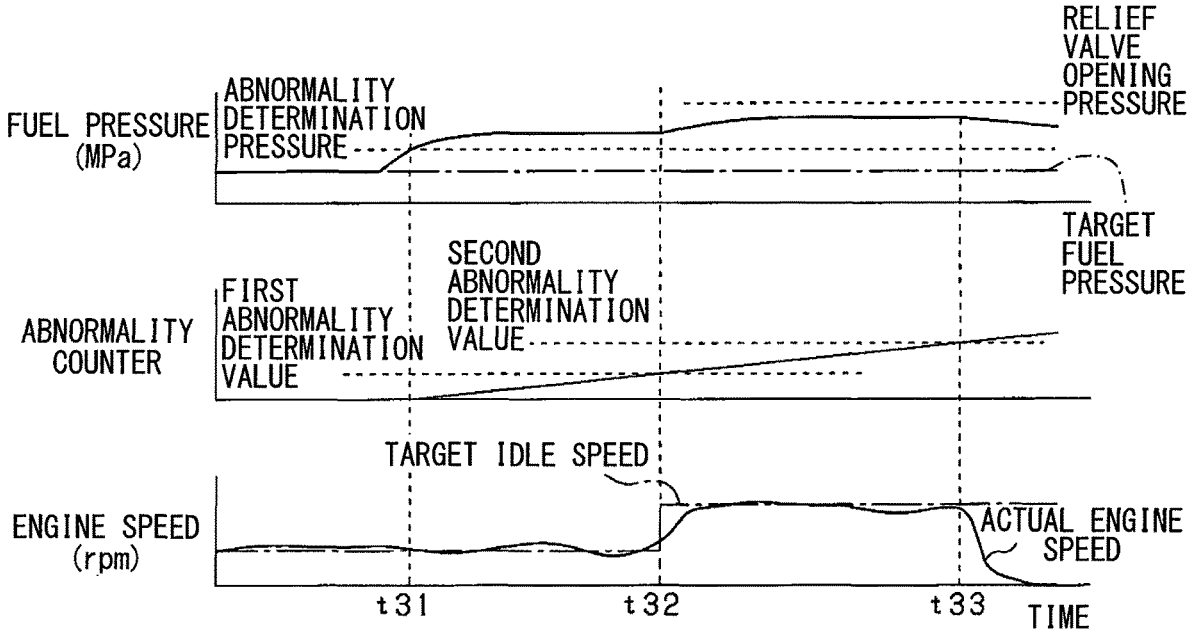
FIG. 8 is a time chart showing another operation of the engine control shown in FIG. 6.

According to the engine control shown in FIG. 6, when the value of the abnormality counter (i) is larger than the second abnormality determination value, the engine 10 is shut down. FIG. 8 is a time chart showing the above operation.

At a time of t31, the fuel pressure in the delivery pipe 60 becomes higher than the abnormality determination pressure, and the abnormality counter (i) starts counting. After the time of t31, the fuel pressure in the delivery pipe 60 increases, but does not reach the valve opening pressure of the relief valve 80. At a time of t32, the value of the abnormality counter (i) becomes larger than the first abnormality determination value and the target idle speed of the engine 10 is increased to 1000 rpm. After the time of t32, the fuel amount discharged from the high-pressure fuel pump 30 is increased, and the fuel pressure in the delivery pipe 60 is increased. But, the fuel pressure in the delivery pipe 60 does not reach the valve opening pressure of the relief valve 80. At a time of t33, the value of the abnormality counter (i) becomes larger than the second abnormality determination value, and the engine 10 is shut down. After the time of t33, since the high-pressure fuel pump 30 stops the fuel discharge, the fuel pressure in the delivery pipe 60 is gradually decreased.

The engine speed can be increased more than the idle speed due to an accelerator operation by a driver of the vehicle. Also in this case, the discharge amount of the high-pressure fuel pump 30 is increased and the fuel pressure in the delivery pipe 60 becomes higher than the valve opening pressure of the relief valve 80, so that the relief valve 80 is opened to decrease the fuel pressure in the delivery pipe 60. The target idle speed of the engine 10 is set to 600 rpm.

The present embodiment described above has following advantages.

When the fuel pressure in the fuel pipe 60 has been higher than the abnormality determination pressure for a period which is longer than the first period, the idle speed of the engine 10 is increased to a specified speed. The high-pressure fuel pump 30 is driven by the crankshaft 12 of the engine 10. By increasing the idle speed of the engine 10, the discharge amount of the high-pressure fuel pump 30 can be increased. Thus, even if the high-pressure fuel pump 30 is deteriorated or the low viscosity fuel is used, the fuel pressure in the delivery pipe 60 can be easily increased to the valve opening pressure of the relief valve 80. As a result, when the high-pressure fuel pump 30 has a malfunction, the fuel pressure in the delivery pipe 60 can be easily decreased, so that the design withstand pressure of the delivery pipe 60 can be lowered.

When the idle speed of the engine 10 is increased to the predetermined speed and the fuel pressure in the delivery pipe 60 has been higher than the abnormality determination pressure for the second period or longer, the engine 10 is shut down. When the relief valve 80 is not opened even though the idle speed of the engine 10 is increased, the engine 10 is shut down so that a deterioration in withstand pressure of the delivery pipe 60 can be restricted.

Since the fuel is returned from the delivery pipe 60 to the low pressure chamber 40 through the relief valve 80, it can be restricted that the fuel temperature in the fuel tank 18 is increased.

The abnormality determination pressure is set lower than the upper limit pressure at which the fuel injection by the fuel injector 62 can be controlled. Thus, even when the high-pressure fuel pump 30 has a malfunction, it can be avoided that the fuel injection by the fuel injector 62 becomes uncontrollable.

The abnormality determination pressure is set lower than the withstand pressure when the delivery pipe 60 is deteriorated. Thus, even when the delivery pipe 60 is deteriorated and the high-pressure fuel pump 30 has a malfunction, the fuel pressure in the delivery pipe 60 can be kept lower than the withstand pressure.

It should be noted that the above embodiment may be modified as follows. The same members as those of the above embodiment are denoted by the same reference numerals, and the description thereof will be omitted.

When the fuel pressure has been higher than the abnormality determination pressure for the first period or longer, the idle speed of the engine 10 may be increased to 800 rpm or 1200 rpm.

The fuel can be returned from the delivery pipe 60 to the pipe 22 and the fuel tank 18 through the relief valve 80.

In the flowchart of FIG. 6, the processes of S17 and S18 can be omitted.

As the engine 10, not only a direct injection engine using gasoline as a fuel but also a direct injection engine using ethanol as a fuel, or a diesel engine including a common rail can be adopted.

Although the present disclosure is described based on the above embodiments, the present disclosure is not limited to the embodiments and the structures. The present disclosure is intended to cover various modification and equivalent arrangements. Furthermore, various combination and formation, and other combination and formation including one, more than one or less than one element may be made in the present disclosure.

The invention claimed is:

1. A control device for an internal combustion engine which is provided with a high-pressure fuel pump driven by a driving shaft of the internal combustion engine to discharge a fuel pressurized in a pressurizing chamber, an accumulator accumulating a high-pressure fuel discharged from the high-pressure fuel pump, and a relief valve which is opened when a fuel pressure in the accumulator is higher than a specified pressure in order to return the fuel in the accumulator to a specified chamber where a fuel has lower pressure than a fuel in the pressurizing chamber; wherein an idle speed of the internal combustion engine is increased to a specified speed when the fuel pressure in the accumulator has been higher than a determination pressure, which is lower than the specified pressure, for a first period or longer.

2. The control apparatus for an internal combustion engine according to claim 1, wherein the internal combustion engine is shut down when the idle speed of the internal combustion engine is increased to the specified speed and the fuel pressure in the accumulator has been higher than the determination pressure for a second period or longer.

3. The control apparatus for an internal combustion engine according to claim 1, wherein the internal combustion engine is provided with a low-pressure fuel pump which discharges a pressurized fuel to the high-pressure fuel pump, the specified chamber is a low-pressure chamber which accumulates the fuel discharged by the low-pressure fuel pump.

4. The control apparatus for an internal combustion engine according to claim 1, wherein the determination pressure is set lower than an upper limit pressure at which a fuel injection by the fuel injector is controllable.

5. The control apparatus for an internal combustion engine according to claim 1, wherein the determination pressure is set lower than a withstand pressure when the accumulator is deteriorated.

* * * * *